United States Patent [19]

Ruetz et al.

[11] Patent Number: 4,696,620

[45] Date of Patent: Sep. 29, 1987

[54] FLUID FLOW MACHINE

[75] Inventors: Georg Ruetz, Immenstaad; Jürgen Giesselmann, Markdorf, both of Fed. Rep. of Germany

[73] Assignee: MTU Friedrichshafen GmbH, Fed. Rep. of Germany

[21] Appl. No.: 828,878

[22] Filed: Feb. 13, 1986

[30] Foreign Application Priority Data

Apr. 17, 1985 [DE] Fed. Rep. of Germany ..... 3513823

[51] Int. Cl.[4] ..... F01D 17/14

[52] U.S. Cl. ..... 415/164; 415/148

[58] Field of Search ..... 415/148, 149 R, 159, 415/163, 164, 165, 166, 162, 206, 219 R, 219 C

[56] References Cited

U.S. PATENT DOCUMENTS

| | | | |
|---|---|---|---|
| 2,715,814 | 8/1955 | Barr | 415/164 |
| 2,860,827 | 11/1958 | Egli | 415/164 |
| 2,904,307 | 9/1959 | Balje et al. | 415/164 |
| 3,033,519 | 5/1962 | Radtke | 415/164 |
| 3,101,926 | 8/1963 | Weber | 415/164 |
| 3,243,159 | 3/1966 | Hefler et al. | 415/166 |
| 3,349,997 | 10/1967 | Beran et al. | 415/148 |

FOREIGN PATENT DOCUMENTS

| | | |
|---|---|---|
| 2333525 | 1/1975 | Fed. Rep. of Germany . |
| 1049080 | 11/1966 | United Kingdom . |

*Primary Examiner*—Robert E. Garrett
*Assistant Examiner*—John Kwon

[57] ABSTRACT

A compressor or a turbine of the radial type of construction as is used, for example, for exhaust gas turbocharging of an internal combustion engine. Adjustable guide wheels are coordinated to a radial turbine or compressor rotor in a radially traversed annular space of the fluid flow housing, whose guide blades are constructed in each case in one piece with the bearing pins and the actuating levers projecting at an angle from the bearing pins. For facilitating assembly of such guide blades in bearing apertures of a housing wall of the fluid flow housing, the housing wall is divided along the center of the bearing bores. As a result thereof, the bearing bores are radially accessible for the insertion of the bearing pins. With this construction of housing and guide wheel, the assembly expenditure is considerably smaller than with multipartite construction of the blades. At the same time, the operating reliability of the fluid flow machine is increased with the few detachable connections.

5 Claims, 4 Drawing Figures

FLUID FLOW MACHINE

The present invention relates to a fluid flow machine with a radial rotor arranged in a fluid flow housing as well as with a guide wheel arranged in an annular space of the fluid flow housing through which the fluid medium flows radially, as described, for example, in the DE-OS No. 23 33 525.

An exhaust gas turbocharger with a compressor and a turbine of the radial flow type of construction is disclosed in the aforementioned publication. Adjustable guide blades are arranged in a radially traversed annular channel ahead of the rotor of the turbine which are adjustable in the fluid flow depending on the manner of operation of an internal combustion engine. The adjustment of the guide blades takes place by way of working cylinders actuatable by a pressure medium, which apply a circumferential force at a lever of an adjusting ring adjustable in the circumferential direction. Actuating levers coupled with the guide blades are connected with the adjusting ring which are disposed radially pointing toward the fluid flow machine axis. The bearing support of the guide blades takes place on bearing pins which are rotatably guided within bearing bores in the adjoining wall part of the turbine housing. This wall part is secured at the bearing housing of the shaft common to the turbine and compressor rotor and forms the turbine housing together with the shaped housing part for the flow inlet and outlet. It is disadvantageous with this prior art construction that the installation of adjustable guide mechanisms has to be paid with considerable increased costs. This is due above all also to the high assembly expenditure which is necessary when extending the bearing pins through the bearing bores of the housing wall and subsequently fastening the actuating levers at the bearing pins. Additionally, an expensive connecting technique is necessary with the high thermal and also mechanical loads of the connection.

It is the object of the present invention to simplify the manufacture and assembly of adjustable guide wheels in fluid flow machines and to render the same less expensive and additionally increase the operating safety.

The underlying problems are solved with an installation of the aforementioned type in that the housing wall ring is divided along the center of the bearing bores and the guide blades are constructed in one piece with the bearing pins and the actuating levers. The operating reliability of the fluid flow machine is increased in that the number of detachable connections is kept small. At the same time, however, also the assembly of adjustable guide installations is simplified and rendered less costly thereby because corresponding work-intensive assembly operations can be economized. This is achieved in that, on the one hand, the guide blades are constructed in one piece with the bearing pins and the actuating levers and, on the other, the housing wall in which the guide blades are to be rotatably fastened, are split or divided in the center of the bearing bores, thus the bearing bores are cut open, i.e., are radially accessible. The guide blades which are connected with actuating levers and bearing pins and which cannot be inserted axially into a bore, can then together with the bearing pins be radially inserted in their bearing halves at one of the housing wall parts resulting from the division. The thus assembled structural group is then axially assembled with the housing wall part forming the shaped counter-part. The actuating levers are so attached at the bearing pins that they lie to one side of the separating line.

It is also advantageous that with guide blades constructed in one piece with the actuating levers, the direction of departure of the actuating lever is fixed exactly and nonchangeably relative to the guide blade position. Furthermore, a reduction of the large number of parts is also of advantage. It is also possible to make the guide blades together with bearing pins and actuating levers completely of high-temperature-resistant ceramic material. Problems which normally result with connections of other materials with ceramic material cannot occur at all with a one-piece construction.

These and other objects, features and advantages of the present invention will become more apparent from the following description when taken in connection with the accompanying drawing which shows, for purposes of illustration only, two embodiments in accordance with the present invention, and wherein.

Figure 1:
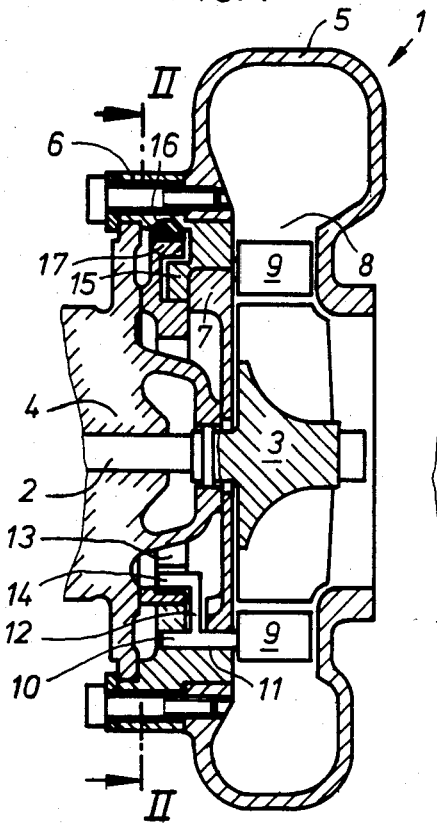
FIG. 1 is a cross-sectional view through the turbine longitudinal axis of a turbine with an adjustable guide installation in accordance with the present invention, taken along line I—I of FIG. 2.

Referring now to the drawing wherein like reference numerals are used throughout the various views to designate like parts, the turbine generally designated by reference numeral 1 which is illustrated in cross-sectional view in FIG. 1, is a part of an exhaust gas turbocharger of an internal combustion engine (not shown). The compressor which also is not shown in the drawing, is connected with the turbine rotor 3 by way of a shaft 2. The shaft 2 is supported in a bearing housing 4 only shown in part, to which is attached the fluid flow housing or, in this case, the turbine housing composed of different housing parts. The turbine housing consists of an inner housing wall ring 7 and of an outer housing wall ring 6 as well as of a housing part 5, which includes the formed-on fluid inlet and outlet. The radial turbine rotor 3 is arranged in the turbine housing while an adjustable guide wheel is arranged in an annular space 8 radially traversed by the flow medium. The guide blades 9 of the guide wheel are supported on bearing pins 10 within bearing bores 11 in the housing wall rings 6 and 7 that abut at the bearing housing 4. The guide blades 9 are constructed in one piece together with the bearing pins 10 as well as with the actuating levers 12 and with the axially directed engaging cams 14 engaging in apertures of an adjusting ring 13. The housing wall in which the bearing pins 10 are supported is of two-partite construction consisting of the inner housing wall ring 7 and of the outer housing wall ring 6. The separating surface of the two housing parts 7 and 6 extends along the center of the bearing bores 11. The housing part 5 is securely screwed onto the outer housing wall ring 6 which is clamped fast at the bearing housing 4; the spiral space for the flow medium inlet and the axial flow medium outlet are formed-on at the housing part 5. The outer housing wall ring 6 includes a formed-on annular flange 15 which is drawn radially inwardly over the separating surface in circumferential areas between the bearing bores 11 for threadably connecting the inner housing wall ring 7. In order not to impair the pivoting of the actuating levers 12, corresponding apertures are provided (see also FIG. 2, dash lines). The adjusting ring 13 is rotatably supported at this ring flange 15 and the bearing housing 4.

Figure 2:
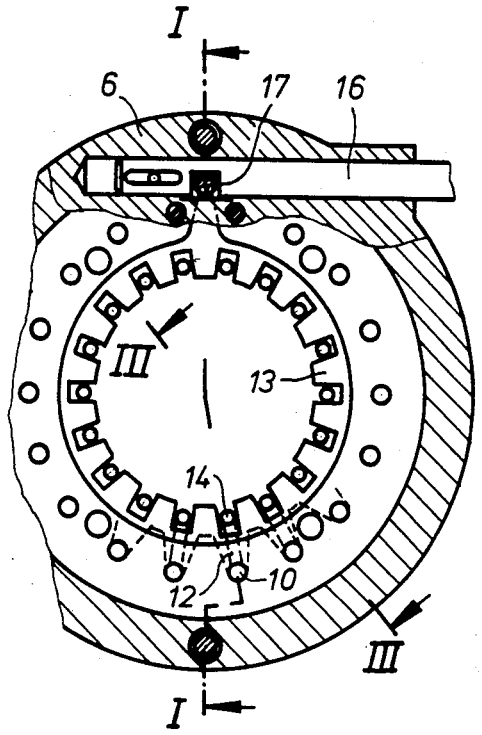
FIG. 2 is a transverse cross-sectional view of the turbine taken along line II—II of FIG. 1.

As can be seen from FIG. 2, which represents a cross-section along the cross-sectional line II—II of FIG. 1, the guide blade adjustment takes place by way of an adjusting pin 16 which is actuated by any known means not illustrated in detail. The adjusting pin 16 which is guided in a tangentially disposed bore of the housing wall ring 6, is coupled with the adjusting lever 17 of the adjusting ring 13 by way of a groove. By an axial movement of the adjusting pin 16, the engaging cams 14 of the actuating levers 12 receive a circumferential displacement which effects a rotation of the bearing pins 10. The radial grooves at the adjusting ring 13 thereby also permit the small radial movements of the engaging cams 14 which occur with the circumferential movement.

Figure 3:
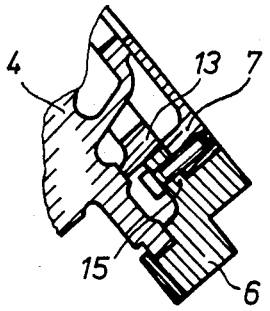
FIG. 3 is a partial cross-sectional view taken along line III—III of FIG. 2 which illustrates the threaded connection between the separate housing wall parts.

In FIG. 3 which represents a cross section along the cross-sectional line III—III of FIG. 2, the threaded connection between the inner housing wall ring 7 and the outer housing wall ring 6 is illustrated.

Figure 4:
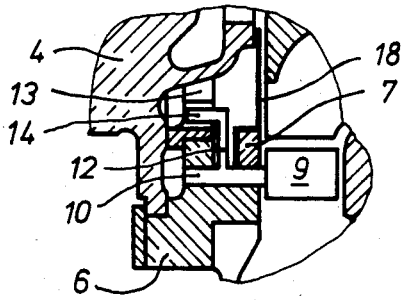
FIG. 4 is a partial cross-sectional view corresponding to FIG. 1 of a modified embodiment of the fluid flow housing division within the area of the bearing bores in accordance with the present invention.

FIG. 4 illustrates a partial cross-sectional view corresponding to FIG. 1 of the bearing support and housing parts within the area of the guide wheel. The inner housing wall ring 7 is constructed in this case as ring, at which abuts a sheet-metal shield member 18 forming the housing wall.

The assembly of the turbine housing can be described by reference to FIGS. 1 to 3 as follows:

The guide blades 9 constructed in one piece with bearing pins 10 and actuating levers 12 can be placed together with the bearing pins 10 in the radially accessible apertures of the bearing bores 11 in the separating surface at the inner housing wall ring 7—eventually with the assistance of a suitable assembly device. In an axial relative movement the outer and inner housing wall rings 6 and 7 are joined and connected together with few screws (see FIG. 3). The bearing pins 10 which are extended beyond the attachment of the actuating levers 12 are also received in the bores of the ring flange 15. After the insertion of the engaging cams 14 of the actuating levers 12 in the adjusting ring 13, the housing parts can be assembled at the bearing housing 4.

The connection of the housing wall rings takes place, as described, by a threaded connection of the inner housing wall ring with a ring flange preferably formed-on at the outer housing wall ring. However, the connection may also take place—though not illustrated—by radial fixing pins and a radial threaded connection transversely to the bearing bores.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A fluid flow machine, comprising fluid flow housing means, a radial rotor arranged in said housing means, said housing means including an annular space which is radially traversed by the fluid medium, a guide wheel arranged in said annular space whose adjustable guide blades are operatively connected with bearing pins aligned substantially parallel to the rotor axis, bearing housing means for a rotor shaft, said bearing pins being rotatably supported in bearing bores of a housing wall ring means attached at the bearing housing means and forming a housing part of the fluid flow housing means, said bearing pins being operatively connected with actuating lever means which cooperate with an adjusting ring means for the guide blade adjustment, the housing wall ring means being divided along the center of the bearing bores, and the guide blades being constructed in one piece with the bearing pins and the actuating lever means.

2. A fluid flow machine according to claim 1, wherein the housing wall ring means includes outer and inner housing wall ring means operable to be threadably connected with each other by way of a ring flange which radially overlaps the housing wall ring means within areas between the bearing bores, said ring flange being provided with apertures corresponding to the pivot possibilities of the actuating levers.

3. A fluid flow machine according to claim 2, wherein the ring flange is constructed in one piece with the outer housing wall ring means.

4. A fluid flow machine according to claim 2, wherein the ring flange is provided with bores for the bearing support of bearing pin ends extended beyond the attachment of the actuating levers.

5. A fluid flow machine according to claim 4, wherein the ring flange is constructed in one piece with the outer housing wall ring means.

* * * * *